United States Patent [19]

Cochran

[11] 4,280,472

[45] Jul. 28, 1981

[54] MASONRY SAW

[75] Inventor: Clarence D. Cochran, Blytheville, Ark.

[73] Assignee: John Cochran, Tunica, Miss.

[21] Appl. No.: 95,670

[22] Filed: Nov. 19, 1979

[51] Int. Cl.[3] ..... B28D 1/04

[52] U.S. Cl. ..... 125/13 R

[58] Field of Search ..... 125/13 R, 13 SS; 51/99

[56] References Cited

U.S. PATENT DOCUMENTS

| | | | |
|---|---|---|---|
| 1,789,125 | 1/1931 | Wilderson | 125/13 SS |
| 2,014,229 | 9/1935 | Emmons | 125/13 R |
| 2,441,535 | 5/1948 | Sanders | 125/13 SS |
| 2,464,117 | 3/1949 | Coates | 125/13 SS |
| 2,624,984 | 1/1953 | Zuzelo | 125/13 SS |
| 2,819,709 | 1/1958 | MacGregor | 125/13 SS |
| 4,107,880 | 8/1978 | Randall | 51/99 |

*Primary Examiner*—Harold D. Whitehead

*Attorney, Agent, or Firm*—Walker & McKenzie

[57] ABSTRACT

A masonry saw including a base for being attached to a scaffold or attached to a support frame which rests on the ground. A masonry saw blade and a motor for rotating the saw blade are mounted to the base. A carriage is slidably supported on the base for supporting a piece of masonry to be cut and for moving the piece of masonry into the saw blade. A miter support member is attached to the carriage for positioning the piece of masonry at a specific angle relative to the plane of the saw blade and for supporting the rear of the piece of masonry on both sides of the kerf made therein by the saw blade.

4 Claims, 15 Drawing Figures

MASONRY SAW

BACKGROUND OF THE INVENTION

1. Field of the Invention

This invention relates generally to saws and more specifically to saws for cutting pieces of masonry.

2. Description of the Prior Art

Heretofore, various masonry saws and the like have been developed. See, for example, Coates, U.S. Pat. No. 2,464,117; Scott, U.S. Pat. No. 2,591,206; Harrison, U.S. Pat. No. 2,716,402; Tucker, U.S. Pat. No. 2,726,651; Cooper, U.S. Pat. No. 2,998,812; Wilson, U.S. Pat. No. 2,998,213; May, U.S. Pat. No. 3,090,615; Harclerode, U.S. Pat. No. 3,635,206; and Harding, U.S. Pat. No. 3,807,095. None of the above patents disclose or suggest the present invention.

SUMMARY OF THE INVENTION

The present invention is directed towards improving upon prior masonry saws. The concept of the present invention is to provide a masonry saw which can be safely used on a scaffold or on the ground and which will safely cut pieces of masonry at desired angles, etc.

The masonry saw of the present invention includes, in general, a base means having a bed, an upwardly extending member attached to the bed, and a plurality of downwardly extending foot members attached to the bed, the foot members being arranged so as to fit on opposite sides of a plank member of a scaffold; a motor means attached to the upwardly extending member of the base means, the motor means including a rotating shaft; a masonry saw blade attached to the shaft of the motor means for rotating above the bed of the base means; and a carriage means slidably mounted on the bed of the base means for supporting a piece of masonry to be cut and for moving the piece of masonry into the saw blade.

DESCRIPTION OF THE PREFERRED EMBODIMENT

Figure 1:
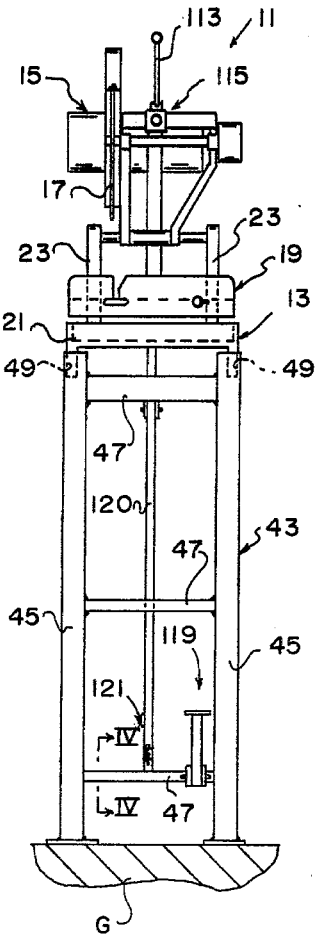
FIG. 1 is a front elevational view of the masonry saw of the present invention shown supported on the ground.

The masonry saw 11 of the present invention is used to cut pieces of masonry M such as brick, tile or the like. The masonry saw 11 includes, in general, a base means 13, a motor means 15, a masonry saw blade 17, and a carriage means 19 (see, in general, FIGS. 1 and 2).

Figure 2:
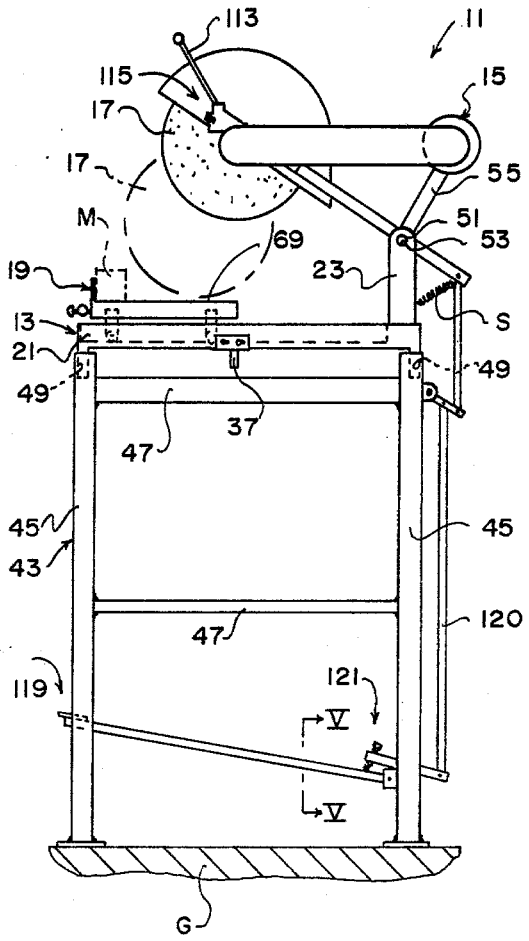
FIG. 2 is a side elevational view thereof.
Figure 10:
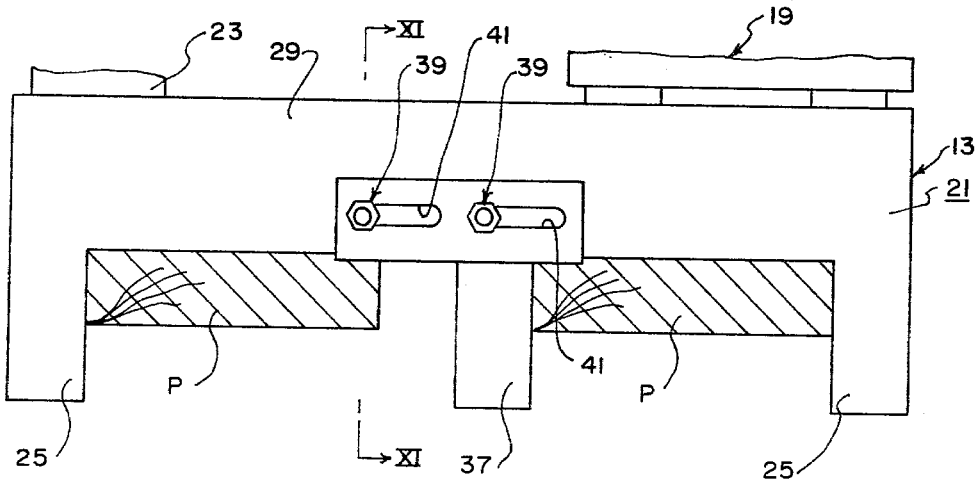
FIG. 10 is a side elevational view of a portion thereof shown supported by the plank members of a scaffold.
Figure 11:
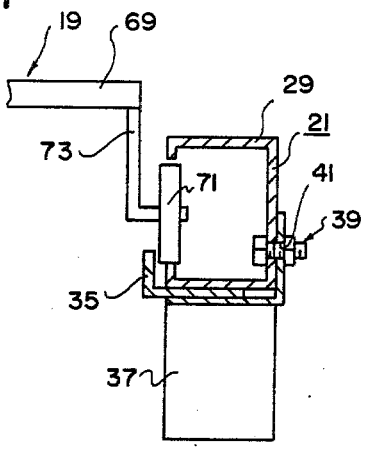
FIG. 11 is a sectional view as taken on line XI—XI of FIG. 10.
Figure 12:
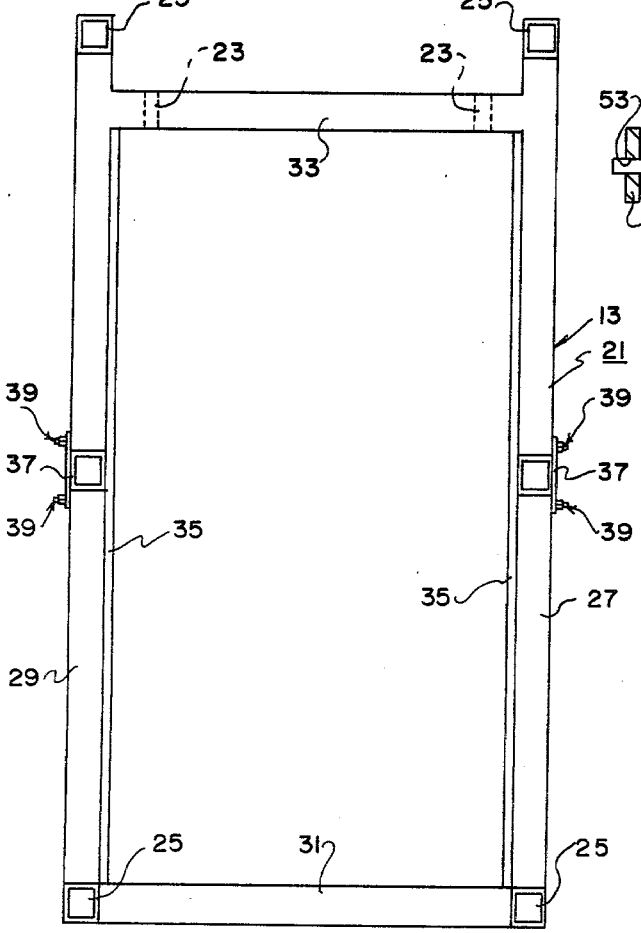
FIG. 12 is a bottom view of a portion thereof.

The base means 13 includes a bed 21, at least one end preferably a pair of upwardly extending support members 23 attached to the bed 21, and a plurality of downwardly extending foot members 25 attached to the bed 21 (see, in general, FIGS. 1 and 2). The bed 21 may consist of an open parallelogram formed out of a pair of elongated side members 27, 29 joined together by an elongated front member 31 and an elongated rear member 33 (see, in general, FIG. 12). The members 27, 29, 31, 33 may be joined together in any manner apparent to those skilled in the art such as by welding or the like. The inner portion of each side member 27, 29 is preferably adapted to slidably receive the carriage means 19. For example, an elongated flange member 35 may be attached to each side member 27, 29 (see, in general, FIGS. 11 and 12) for slidably supporting a portion of the carriage means 19 in a manner which will hereinafter be explained. The flange members 35 may be attached to the side members 27, 29 in any manner apparent to those skilled in the art such as by way of screws or the like. Foot members 25 are preferably provided at the forward and rearward ends of each side member 27, 29 (see FIG. 12). The side members 27, 29 may extend rearwardly of the rear member 33 as shown in FIG. 12. A downwardly extending adjustable foot member 37 is preferably provided on each side member 27, 29 intermediate the front and rear members 31, 33 (see, in general, FIG. 12). The foot members 37 may be adjustably attached to the side members 27, 29 in any manner apparent to those skilled in the art, such as by way of the coaction between bolts 39 attached to the side members 27, 29 and elongated slots 41 in a portion of the foot members 37 for coacting in a manner which should now be apparent to those skilled in the art (see, in general, FIGS. 10 and 11). The adjustable foot members 37 are utilized to attach the base means 13 to a plank member P of a typical scaffold. More specifically, the foot members 25 adjacent one end of the side members 27, 29 are positioned on one side of the plank member P and the foot members 37 are adjusted so as to substantially clamp the plank member P between the foot member 25, 37 as shown in FIG. 10 and as should now be apparent to those skilled in the art.

The masonry saw 11 may include a support frame means 43 for resting upon a supporting surface such as the ground G to selectively support the base means 13 above the ground G when it is desired to use the masonry saw 11 on the ground G or the like rather than on a scaffold or the like (see FIGS. 1 and 2). The support frame means 43 preferably consists of elongated leg members 45 joined together by a plurality of cross members 47 as shown in FIGS. 1 and 2. The leg members 45 and cross members 47 may be joined together in any manner apparent to those skilled in the art such as by welding or the like. The upper end of each leg member 45 is provided with an aperture 49 for receiving a foot member 25 of the base means 13 whereby the base means 13 can be substantially firmly attached to the support frame means 43 and thereby supported above the ground G in a manner as should now be apparent to those skilled in the art.

Figure 13:
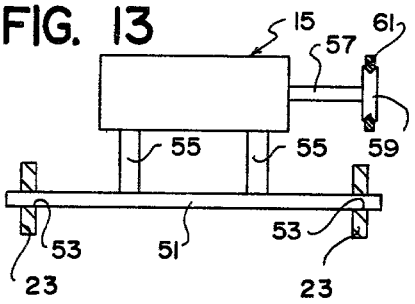
FIG. 13 is a somewhat diagrammatic view of a portion thereof.

The motor means 15 may consist of any typical electric motor or the like known to those skilled in the art. The motor means 15 is preferably mounted on the upwardly extending support member 23 of the base means 13 in any manner apparent to those skilled in the art. For example, a shaft member 51 may extend between the upper end of the support members 23 and be attached thereto in any manner apparent to those skilled in the art such as by way of extending through an aperture 53 in each support member 23, and the motor means 15 may be fixedly attached to the shaft member 51 by way of one or more bridge members 55 extending between the motor means 15 and the shaft member 51 (see, in general, FIG. 13). The bridge members 55 may be fixedly attached to the motor means 15 and the shaft member 51 in any manner apparent to those skilled in the art such as by welding or the like. The motor means 15 includes a rotating shaft 57 for being coupled to the saw blade 17 to cause the saw blade 17 to rotate (see, in general, FIG. 13). Preferably, a pulley 59 is fixedly attached to the outer end of the shaft 57 for causing rotation of an endless belt member 61 (see, in general, FIG. 13) which will transfer rotation to the saw blade 17 in a manner which will hereinafter be explained.

Figure 14:
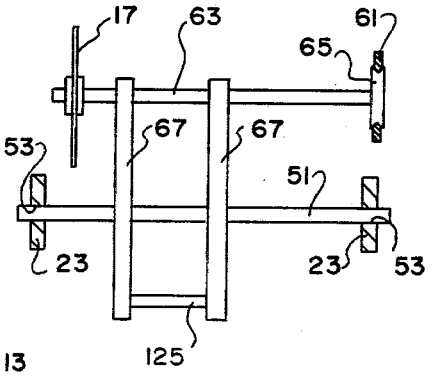
FIG. 14 is a somewhat diagrammatic view of a portion thereof.

The saw blade 17 is of any typical type well known to those skilled in the art for use in cutting masonry and the like. The saw blade 17 is preferably attached to the shaft 57 of the motor means 15 for rotating above the bed 21 of the base means 13. More specifically, the saw blade 17 is preferably fixedly attached to a shaft member 63 in any manner apparent to those skilled in the art such as by way of a nut assembly or the like (see, in general, FIG. 14). The outer end of the shaft member 63 preferably has a pulley 65 attached thereto for receiving the endless belt member 61 whereby rotation of the shaft 57 of the motor means 15 will be transferred to the blade 17 to cause rotation thereof. The shaft member 63 may be supported from the shaft member 51 by way of one or more bridge members 67 whereby the blade 17 will be supported above the base means 13 and the carriage means 19 (see, in general, FIG. 14). The bridge members 67 may be attached to the shaft members 51, 63 in any manner apparent to those skilled in the art, such as by way of bushings (not shown) or the like.

Figure 9:
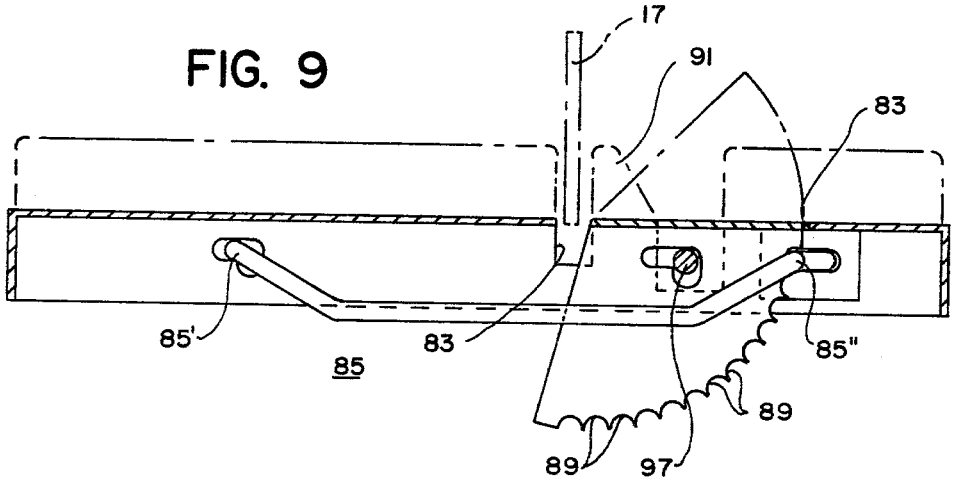
FIG. 9 is a sectional view as taken on line IX—IX of FIG. 6.

The carriage means 19 is adapted to be slidably mounted on the bed 21 of the base means 13 (see, in general, FIGS. 1 and 2). The carriage means 19 includes a table means 69 for receiving and supporting the piece of masonry M to be cut and includes support means for slidably supporting the table means 69 on the bed 21 of the base means 13. The support means preferably includes a plurality of roller members 71 (only one of which is shown) attached to the table means 69 by way of bridge members 73 or the like (see FIG. 11). The roller members 71 are slidably supported on the side members 27, 29 of the bed 21 of the base means 13 (see, for example, FIG. 11) to thereby support the carriage means 19 on the bed 21 of the base means 13 in a manner which allows the carriage means 19 to be manually moved in a forward and rearward direction on the bed 21. The flange members 35 will prevent accidental separation of the carriage means 19 and bed 21. The table means 69 includes a first member 75 having a top surface 77 and includes a second member 79 having a top surface 81 (see, in general, FIGS. 6 and 9). The top surfaces 77, 81 coact to support the piece of masonry M to be cut. The carriage means 19 is preferably attached to the base means 13 in such a manner that the top surface 77 of the first member 75 is maintained substantially perpendicular to the plane of the blade 17. The second member 79 is preferably pivotally mounted to the first member 75 for allowing the top surface 81 to be moved from a normal or flat position aligned with the top surface 77 and as shown in solid lines in FIG. 9, to various angled positions (one of which being shown in broken lines in FIG. 9) whereby the piece of masonry M to be cut can be selectively supported at an angle to the top surface 77 for reasons which will be apparent to those skilled in the art. The first member 77 is preferably provided with a cut-out portion as at 83 (see FIG. 9) and the second member 79 is preferably mounted in this cut-out portion 83. The second member 79 may be pivotally attached to the first member 75 in any manner apparent to those skilled in the art such as by way of a pivot rod or the like (not shown). The table means 69 may be provided with a lock mechanism to selectively lock the second member 79 in a desired position. The lock mechanism may include an elongated rod member 85 having a first end 85' which terminates in a handle 87 extending outward of the first member 77 and having a second end 85" which engages portions of the second member 79 to selectively lock the second member 79 in a desired position (see, in general, FIGS. 6 and 9). The second member 79 may include a plurality of notches 89 for being selectively engaged by the second end 85" of the rod member 85 to allow the lock mechanism to lock the second member 79 in a desired position in a manner which should now be apparent to those skilled in the art.

Figure 8:
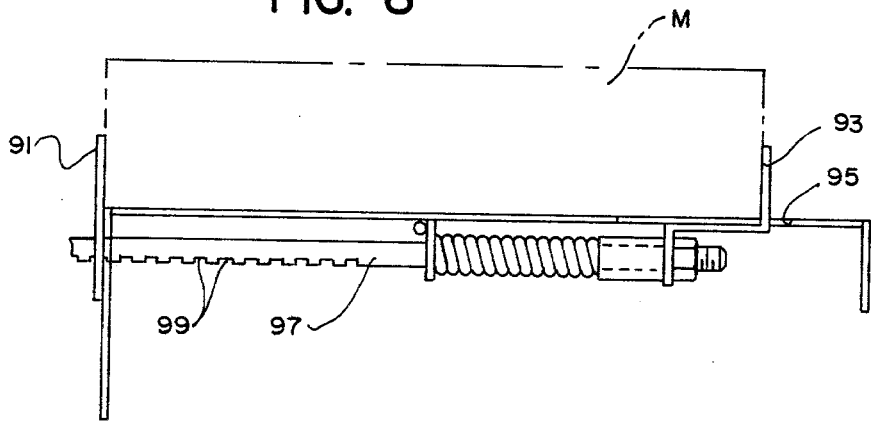
FIG. 8 is a sectional view as taken on line VIII—VIII of FIG. 6.

The carriage means 19 may include a cinch means for locking the piece of masonry M to be cut to the second member 79. The cinch means may include a first upstanding flange member 91 fixedly attached to the first member 75 of the table means 69 adjacent the outer end of the second member 79 and may include a second upstanding flange member 93 slidably attached to the second member 79 (see, in general, FIG. 8). The cinch means is adapted to allow the second upstanding flange member 93 to be selectively drawn towards the first upstanding flange member 91 to fixedly secure the piece of masonry M to be cut therebetween in a cinch-like manner as should now be apparent to those skilled in the art. The second member 79 may include an elongated slot 95 in the top surface 81 thereof and a portion of the second upstanding flange member 93 may extend through the slot 95 and be attached to an elongated rod member 97 which extends outward of the table means 69 (see, in general, FIGS. 6, 8 and 9) whereby movement of the rod member 97 will cause movement of the second upstanding flange member 93. The rod member 97 may be provided with notches 99 for allowing the rod member 97 to be selectively locked in various positions whereby the second upstanding flange member 93 can be locked in various positions (see FIG. 8).

Figure 6:
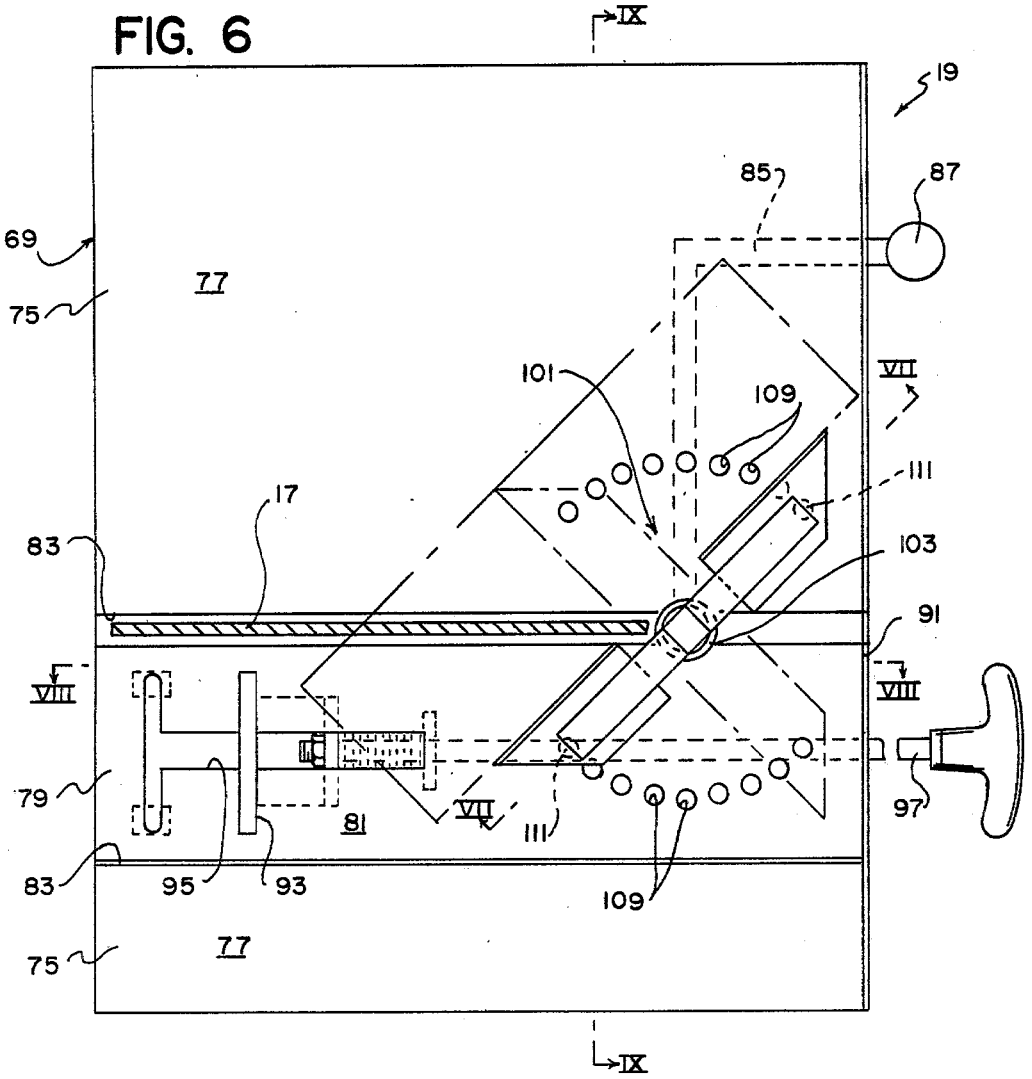
FIG. 6 is a top plan view of a portion thereof.
Figure 7:
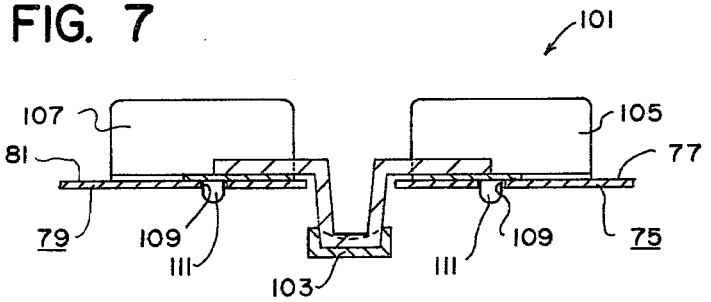
FIG. 7 is a sectional view as taken on line VII—VII of FIG. 6.

The masonry saw 11 may include a miter means 101 for being attached to the carriage means 19 and for positioning the masonry M to be cut at a specific angle relative to the blade 17 (see, in general, FIG. 6). The miter means 101 preferably includes a pivot member 103 for being pivotally attached to the table means 69 of the carriage means 19 about a substantially vertical axis aligned with the plane of the saw blade 17. The miter means 101 also preferably includes first and second arm members 105, 107 fixedly attached to the pivot member 103 for engaging portions of the piece of masonry M to be cut. The first and second arm members 105, 107 are positioned on opposite sides of the pivot member 103 and on opposite sides of the plane of the saw blade 17 for supporting the piece of masonry M to be cut on both sides of the saw blade 17. The top surfaces 77, 81 of the first and second members 75, 79 of the table means 69 preferably have a plurality of apertures 109 therein spaced about the pivot member 103 as clearly shown in FIG. 6. A downwardly extending peg member 111 is attached to each arm member 105, 107 for being positioned in one of the apertures 109 to thereby lock the arm members 105, 107 in a desired position relative to the blade 17 (see FIG. 7).

Figure 3:
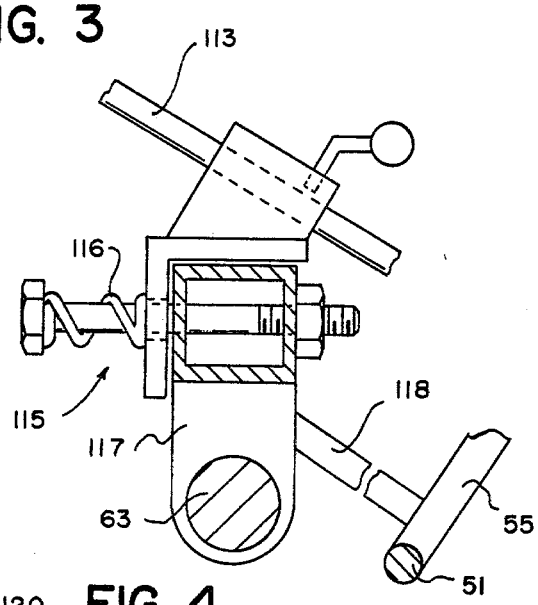
FIG. 3 is a sectional view of a portion thereof.

The saw blade 17 is preferably moveable between raised and lowered positions above the carriage means 19 (see, in general, FIG. 2). A handle member 113 is attached to the saw blade 17 for allowing the saw blade 17 to be manually moved between the raised and lowered positions. A pressure limit means 115 is preferably associated with the handle member 113 for limiting the amount of pressure applied to the saw blade 17 when it is moved to the lowered position. The pressure limit means 115 includes a spring means 116 located between the saw blade 17 and the handle member 113 (see, in general, FIG. 3). More specifically, the pressure limit means 115 is located between the handle member 113 and a bushing-like member 117 which is mounted on the shaft member 63 (see FIG. 3). One or more bridge members 118 preferably extend from the bushing-like members 117 to the bridge members 55 or the like (see FIG. 3) to prevent rotation of the bushing-like member 117 about the shaft member 63 and to cause the motor means 15 to rotate with the saw blade 17. Thus, downward movement of the handle means 113 will cause the motor means 115 and the saw blade 17 to pivot downward as a unit (the actual pivot is where the shaft member 51 passes through the support members 23). If too great a downward pressure is applied to the handle member 113, the spring means 115 will allow some relative movement between the handle member 113 and the bushing-like member 117 in a manner as will be apparent to those skilled in the art from a study of FIG. 3. A spring S may extend between one of the support members 23 and one of the bridge members 67 (see FIG. 2) for normally holding the saw blade 17 in the raised position.

Figure 4:
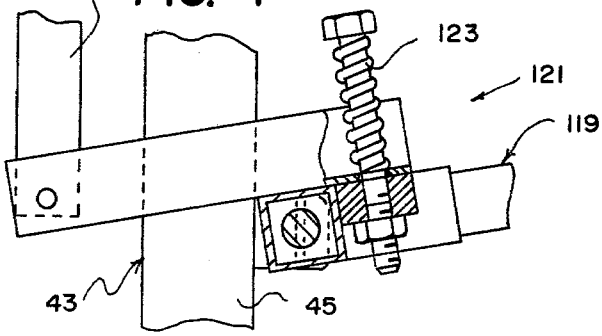
FIG. 4 is a sectional view as taken on line IV—IV of FIG. 1.
Figure 5:
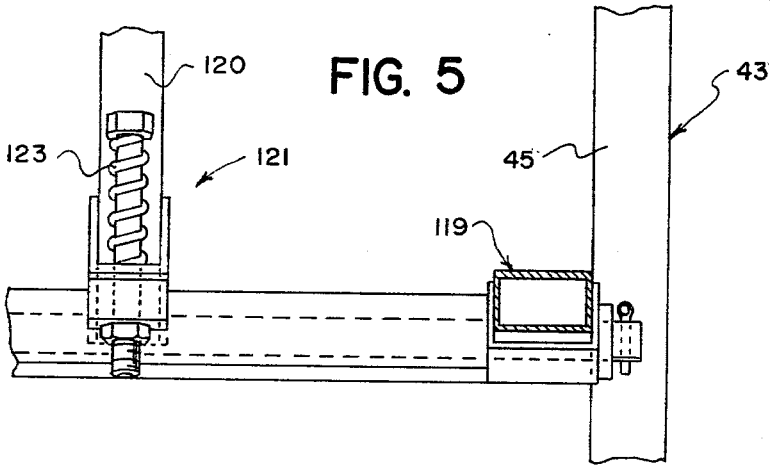
FIG. 5 is a sectional view as taken on line V—V of FIG. 2.
Figure 15:
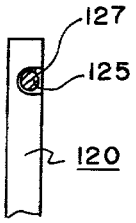
FIG. 15 is a somewhat diagrammatic view of a portion thereof.

The masonry saw 11 preferably includes foot actuable means 119 for moving the saw blade 17 between the raised and lowered positions when the base means 13 is mounted on the support frame means 43. The foot actuable means 119 preferably includes appropriate linkage means 120 connected to the saw blade 17 for causing the saw blade 17 to be moved to the lowered position as shown in broken lines in FIG. 2 when the foot actuable means 119 is pressed downward in any manner as will now be apparent to those skilled in the art. A pressure limit means 121 is preferably associated with the foot actuable means 119 for limiting the amount of pressure applied to the saw blade 17 when it is moved to the lowered position. The pressure limit means 121 includes a spring means 123 located between the saw blade 17 and the foot actuable means 119 (see, in general, FIGS. 2, 4 and 5) and works in substantially the same manner as the pressure limit means 115. The linkage means 120 is preferably coupled to the saw blade 17 by way of an attachment means for allowing the parts to be quickly connected and/or disconnected. The attachment means may consist simply of a cross-member 125 extending between the rearward ends of the bridge members 67 (see, in general, FIG. 14) and a notch 127 on the upper end of the linkage means 120 for being selectively positioned over the cross member 125 (see FIG. 15) whereby the parts can be quickly connected and/or disconnected.

Although the invention has been described and illustrated with respect to a preferred embodiment thereof, it is not to be so limited since changes and modifications may be made therein which are within the full intended scope of the invention.

I claim:

1. A masonry saw for placement on a plank member of a scaffold, said saw comprising:

(a) a base means having a bed, having an upwardly extending member attached to said bed, and having a plurality of downwardly extending foot members attached to said bed; said foot members being arranged so as to fit on opposite sides of the plank member of the scaffold to substantially firmly attach said base means to the plank member;

(b) a motor means attached to said upwardly extending member of said base means, said motor means including a rotating shaft;

(c) a masonry saw blade attached to said shaft of said motor means for rotating above said bed of said base means;

(d) a carriage means slidably mounted on said bed of said base means for supporting a piece of masonry to be cut and for moving the piece of masonry into said saw blade, said saw blade being movable between raised and lowered positions above said carriage means, said carriage means including first and second support portions, said second support portion being pivotally attached to said first support portion to allow said second support portion to be pivoted relative to the longitudinal axis of said carriage means, said carriage means including cinch means for locking a piece of masonry to be cut to said second support portion, said cinch means including first and second flange members positioned above said first support portion, said second flange member being movable towards said first flange member to lock a piece of masonry to be cut to said second support portion;

(e) miter means for being attached to said carriage means and for positioning the piece of masonry to be cut at a specific angle relative to said saw blade, said miter means including a pivot member for being pivotally attached to said carriage means about a substantially vertical axis aligned with the plane of said saw blade, said miter means including first and second arm members fixedly attached to said pivot member for engaging portions of the piece of masonry to be cut; said first and second arm members being positioned on opposite sides of said pivot member and on opposite sides of the plane of said saw blade for supporting the piece of masonry to be cut on both sides of said saw blades, said carriage means having a plurality of apertures spaced about said pivot member of said miter means, said miter means including a peg member attached to said second arm member for being positioned in one of said apertures in said carriage means;

(f) handle means for moving said saw blade between said raised and lowered positions; and (g) pressure limit means for limiting the amount of pressure applied to said saw blade when said saw blade is moved to said lowered position by said handle means; said pressure limit means including a spring means located between said saw blade and said handle means.

2. The saw of claim 1 in which is included support frame means for resting upon a supporting surface, said support frame means including a plurality of downwardly extending leg members having a plurality of apertures for receiving a plurality of said downwardly extending foot members of said base means to substantially firmly attach said base means to said support frame means.

3. The saw of claim 2 in which said saw blade is movable between raised and lowered positions above said carriage means; in which is included foot actuable means for moving said saw blade between said raised and lowered positions; and in which is included attachment means for allowing said foot actuable means to be quickly connected to and disconnected from said saw blade.

4. The saw of claim 3 in which said foot actuable means includes pressure limit means for limiting the amount of pressure applied to said saw blade when said saw blade is moved to said lowered position, said pressure limit means including a spring means located between said saw blade and said foot actuable means.

* * * * *